US009873594B2

(12) United States Patent
Valjus

(10) Patent No.: US 9,873,594 B2
(45) Date of Patent: Jan. 23, 2018

(54) ELEVATOR

(71) Applicant: KONE Corporation, Helsinki (FI)

(72) Inventor: Petteri Valjus, Helsinki (FI)

(73) Assignee: KONE CORPORATION, Helsinki (FI)

( * ) Notice: Subject to any disclaimer, the term of this patent is extended or adjusted under 35 U.S.C. 154(b) by 383 days.

(21) Appl. No.: 14/531,604

(22) Filed: Nov. 3, 2014

(65) Prior Publication Data

US 2015/0122587 A1 May 7, 2015

(30) Foreign Application Priority Data

Nov. 5, 2013 (EP) ..... 13191600

(51) Int. Cl.

| | |
|---|---|
| ***B66B 7/10*** | (2006.01) |
| ***B66B 9/00*** | (2006.01) |
| ***B66B 7/06*** | (2006.01) |
| ***B66B 11/00*** | (2006.01) |

(52) U.S. Cl.

CPC ..... *B66B 9/00* (2013.01); *B66B 7/062* (2013.01); *B66B 7/10* (2013.01); *B66B 11/007* (2013.01)

(58) Field of Classification Search

CPC .. B66B 9/00; B66B 7/062; B66B 7/10; B66B 11/007

USPC ..... 187/264

See application file for complete search history.

(56) References Cited

U.S. PATENT DOCUMENTS 6,193,017 B1 * 2/2001 Koster ..... B66B 7/10 187/256
6,364,061 B2 * 4/2002 Baranda ..... B66B 7/06 187/251
6,364,063 B1 * 4/2002 Aulanko ..... B66B 11/008 187/251
7,207,421 B2 4/2007 Aulanko et al.
7,481,299 B2 1/2009 Mustalahti et al.
7,806,237 B2 * 10/2010 Aulanko ..... B66B 11/08 187/264

(Continued)

FOREIGN PATENT DOCUMENTS

| | | |
|---|---|---|
| DE | 201 22 517 U1 | 1/2006 |
| WO | WO 2004/041699 A1 | 5/2004 |
| WO | 2009/090299 A1 | 7/2009 |

OTHER PUBLICATIONS

European Search Report dated Jan. 30, 2014, issued in European Patent Application No. EP 13 19 1678, in English language.

*Primary Examiner* — Michael Riegelman
(74) *Attorney, Agent, or Firm* — Birch, Stewart, Kolasch & Birch, LLP

(57) ABSTRACT

A counterweightless elevator includes a hoistway, a car vertically movable in the hoistway, one or more suspension ropes, a rotatable drive member engaging said suspension rope(s), each of the suspension rope(s) having a first rope section on the first side of the drive member and a second rope section on the second side of the drive member, and each rope section being connected to the car, said first rope section suspending the car, and a tightening device arranged to tighten the second rope section. Each of said rope(s) is belt-like and includes a load bearing member or a plurality of load bearing members, which load bearing member(s) is/are made of composite material including reinforcing fibers embedded in a polymer matrix, which reinforcing fibers are carbon fibers.

20 Claims, 6 Drawing Sheets

(56) References Cited

U.S. PATENT DOCUMENTS

| | | | | |
|---|---|---|---|---|
| 8,127,893 | B2 * | 3/2012 | Mustalahti | B66B 7/10 187/251 |
| 2003/0155185 | A1 * | 8/2003 | Nomura | B66B 11/009 187/266 |
| 2006/0016641 | A1 | 1/2006 | Koeppe, Jr. | |
| 2007/0012524 | A1 * | 1/2007 | Valjus | B66B 7/10 187/412 |
| 2009/0120733 | A1 * | 5/2009 | Mustalahti | B66B 7/10 187/404 |
| 2009/0229923 | A1 * | 9/2009 | Aulanko | B66B 11/0045 187/266 |
| 2011/0000746 | A1 | 1/2011 | Pelto-Huikko et al. | |
| 2011/0278098 | A1 | 11/2011 | Ketonen et al. | |
| 2013/0048432 | A1 * | 2/2013 | Alasentie | B66B 7/068 187/251 |
| 2014/0305744 | A1 * | 10/2014 | Kere | B66B 7/1238 187/254 |

* cited by examiner

A - A

A - A

A - A

B - B

11'
2'
2a'
2a'
10'
4a'
5a'
4b'
5b'
6'
4c'
f
5c'
2b'
2b'
14'
C - C
C - C
C - C

ELEVATOR

FIELD OF THE INVENTION

The invention relates to an elevator. The elevator is particularly meant for transporting passengers and/or goods.

BACKGROUND OF THE INVENTION

Elevators usually have a drive machine which drives the elevator car under control of an elevator control system. The drive machine typically comprises a motor and a rotatable drive member, such as a drive wheel, engaging an elevator roping which is connected to the car. Thus, the driving force is transmitted from the motor to the car via the drive member and the roping. Conventionally, elevators have a counterweight suspended by a rope section that is on one side of the rotatable drive member and the car by the rope section that is on the other side of the rotatable drive member. The counterweight provides tension for the rope section which does not suspend the car. There are also elevators which do not have a counterweight. These counterweightless elevators have the car suspended by the rope section that is on one side of the rotatable drive member, whereas on the opposite side the elevator comprises some sort of tightening arrangement for tightening the rope section on that side of the rotatable drive member. In these tightening arrangements, formation of loose rope in large scale is typically eliminated by connecting the rope on both sides of the rotatable drive member to the car with same ratio. Thereby, during upwards directed movement of the car also the rope section not suspending the car travels along with the car thereby not piling up anywhere in the hoistway. Furthermore, the tightness may be further increased with a tightening device. This may be needed for one or several of the following reasons. Firstly, by increasing the rope tension of the rope section not suspending the car it is possible to ensure that the rope rests against the rotatable drive member firmly for the whole length of contact between these components, in particular so that a normal force adequate for providing firm engagement between these components is provided. Secondly, in this way the rope tension of the rope section not suspending the car can be increased so as to ensure that the ropes do not jump away from their guide pulleys positioned along the route of the ropes. Furthermore, the rope length in many elevator arrangements changes slightly as a function of car position. The problems caused by this phenomenon can be eliminated by tightening the rope section not suspending the car. There are numerous different existing counterweightless elevators, for example elevators as disclosed in WO2004041699A1.

With existing counterweightless elevators, there have been difficulties to make the system such that the layout of the rope arrangement as well as the overall structure of the tightening arrangement are simple and compact. A drawback has been that the roping has needed a great number of ropes arranged in a complex layout. Also, in existing solutions, it has been difficult to design and dimension the tightening arrangement in a compact fashion yet such that it enables an adequate capacity of tightening. In particular, the range of movement of the movable tightening members has been designed and dimensioned long. A drawback has been that the space consumption of the tightening arrangement as well as the roping has made their space-efficient positioning difficult.

BRIEF DESCRIPTION OF THE INVENTION

The object of the invention is, inter alia, to solve previously described drawbacks of known solutions and problems discussed later in the description of the invention. The object of the invention is to introduce a counterweightless elevator which is improved in simplicity and space-efficiency. In particular, the space-efficiency and simplicity of the hoisting function, including the roping and a tightening device effecting the roping, can be improved. Embodiments are presented, inter alia, where the layout of the bundle of ropes, forming the roping, is simple and compact. Embodiments are presented, inter alia, where the tightening capacity of the tightening arrangement need not be dimensioned as great as previously, yet maintaining good functionality in terms of transport capacity. Embodiments are presented, in particular, where these benefits are obtained with only small or minimal compromises in several other properties of the elevator.

It is brought forward a new counterweightless elevator comprising a hoistway, a car vertically movable in the hoistway, one or more suspension ropes, a rotatable drive member engaging said suspension rope(s) each of the suspension rope(s) having a first rope section on the first side of the drive member and a second rope section on the second side of the drive member, each rope section being connected to the car, said first rope section suspending the car; and a tightening device arranged to tighten the second rope section. Each of said rope(s) is belt-like and comprises a load bearing member or a plurality of load bearing members, which load bearing member(s) is/are made of composite material comprising reinforcing fibers embedded in a polymer matrix, which reinforcing fibers are carbon fibers. Due to this kind of overall cross sectional shape, structure and material selection of the hoisting rope, the simplicity of the roping containing said hoisting ropes can be facilitated, in particular because the number of ropes as well as the cross sectional space consumption of the rope bundle can be reduced. Importantly, due to this kind of overall cross sectional shape, internal structure and material selection of each rope, the tightening capacity of the tightening device can be reduced, most importantly due to an excellent capability to provide high longitudinal stiffness with compact structure. Thereby, a counterweightless elevator with good functionality in terms of transport capacity, space efficiency and simplicity, is obtained.

In a further refined embodiment said load bearing member(s) is/are parallel with the longitudinal direction of the rope. Thereby, the load bearing members are oriented in the direction of the force when the rope is pulled, which increases the tensile stiffness and strength of the rope. Furthermore, it is preferred that said reinforcing fibers are parallel with the longitudinal direction of the load bearing member. In particular, the reinforcing fibers of the same load bearing member are preferably essentially untwisted in relation to each other. Thereby, the reinforcing fibers are oriented in the direction of the force when the load bearing member in question is pulled. This gives the load bearing members an excellent tensile stiffness and strength.

In a further refined embodiment said second rope section is connected to a movably mounted tightening member of the tightening device of the second rope section, which tightening member is movable to tighten the second rope section. The rope structure as defined, providing excellent longitudinal tensile stiffness reduces the need for the length of movement of the movable tightening member thereby enabling a tightening device of this kind which is simple and small in size. Thereby, simplicity and space-efficiency of the elevator can be improved.

In a further refined embodiment the tightening device is mounted on the car at the side thereof, or on the stationary hoistway structures beside the vertical projection of the car, in particular beside the path of the elevator car. This position is enabled by the particular rope structure and shape as defined, in a compact manner.

In a further refined embodiment the tightening device is mounted on the car at the side thereof, or on the stationary hoistway structures beside the vertical projection of the car, in particular beside the path of the elevator car, and the tightening member is movable along a vertical plane, which is parallel with the side wall plane of the car and/or hoistway inner wall plane to tighten the second rope section. The rope structure being as defined, and thereby compact in size, the elevator can be configured to be like this without excessively reducing space-efficiency of the elevator. Thus, the tightening device can be positioned to be in the same space with the car. The tightening member is preferably movable in particular by turning movement and/or by linear movement occurring along a plane, which is parallel with the side wall plane of the car and/or hoistway inner wall plane.

In a further refined embodiment the tightening member is between the vertical side wall plane of the car and the vertical hoistway inner wall plane.

In a further refined embodiment said first rope section, via which the car is suspended, is tensioned by the weight of the car, and guided to pass further to said tightening device of the second rope section and connected in a force transmitting manner to said movably mounted tightening member to pull the tightening member by effect of the rope tension of the first rope section such that the tightening member moves to tighten the second rope section. Thereby first rope section can is used to provide force for a tightening member of the tensioning device, without need for additional actuators.

In a further refined embodiment the end of the first rope section is connected in a force transmitting manner, e.g. fixed, to the movably mounted tightening member to pull the tightening member by effect of the rope tension of the first rope section such that the tightening member moves to tighten the second rope section. In this way, said connection is simply implemented and the end of the first rope section is at the same time provided.

In a further refined embodiment the tightening member is in the form of a tightening pulley around which the second rope section passes, the tightening member being movable in radial direction of the tightening pulley or around its axis, to tighten the second rope section. The ropes of the defined structure facilitate formation of a compact and simple rope bundle, with excellent tensile stiffness. Thereby, the tightening device of the pulley type can be provided good functionality in terms of space consumption of the rope bundle, load bearing capability and space consumption of the movable tightening pulley. Preferably, the plane of rotation of the tightening pulley is parallel with the side wall plane of the car and/or hoistway inner wall plane. Thereby, the radial size thereof is not strictly limited by the space consumption. In a first preferred type, the tightening member is in the form of a tightening pulley around which the second rope section passes is movable in radial direction of the tightening pulley to tighten the second rope section, the second rope section further passing to a rope fixing where the end of the second rope section is fixed, the end of the first rope section being connected in a force transmitting manner (e.g. fixed) to the movably mounted tightening pulley to pull the tightening pulley by effect of the rope tension of the first rope section such that the tightening pulley moves radially to tighten the second rope section. Hereby, a long range of movement is obtainable simply. In a second preferred type, the tightening member is in the form of a tightening pulley around which the second rope section passes against the rim of which the second rope section is fixed, the tightening pulley being movable around its axis to tighten the second rope section, the end of the first rope section being connected in a force transmitting manner to the movably mounted tightening pulley to pull the tightening pulley by effect of the rope tension of the first rope section such that the tightening pulley turns to tighten the second rope section. Hereby, a long range of movement is obtainable with minimal space consumption in radial direction. In this case, preferably the end of the first rope section is connected in a force transmitting manner to the movably mounted tightening pulley via a transmission pulley comprised in the tightening device, which transmission pulley is movable around its axis fixedly and coaxially with the tightening pulley, around which transmission pulley the second rope section passes and against the rim of which the first rope section is fixed. Then the first and second rope sections are arranged on their pulleys such that they pull the tightening pulley by effect of the rope tension to turn it in opposite turning directions, thereby working against each other, the tightening pulley preferably being larger in diameter than transmission pulley a leverage thereby existing between them. Leverage has the benefit of providing a desired level of tightening force, but also the effect of ensuring that tightening range of movement is adequate.

In a further refined embodiment each of said rope(s) has at least one contoured side provided with elongated guide rib(s) and elongated guide groove(s) oriented in the longitudinal direction of the rope, said contoured side being fitted to pass against a contoured circumference of one or more rope wheels of the elevator, said circumference being provided with elongated guide rib(s) and elongated guide groove(s) so that said contoured circumference forms a counterpart for said contoured side(s) of the rope(s).

In a further refined embodiment the elevator comprises a plurality, preferably exactly two, of said ropes, which pass parallelly, at least substantially coplanar, and adjacent in width direction of the rope.

In a further refined embodiment each of said rope(s) has at least one contoured side provided with elongated guide rib(s) and elongated guide groove(s) oriented in the longitudinal direction of the rope, the contoured side of at least the first or the second rope section being fitted to pass against a contoured circumference of a rope wheel of the elevator, which circumference is provided with elongated guide rib(s) and elongated guide groove(s) so that said contoured circumference forms a counterpart for said contoured side(s) of the rope(s), and in that from said rope wheel said first or the second rope section passes downwards or upwards to the tightening device, in particular to a pulley thereof, turning around its longitudinal axis. Thereby, the rope section arriving to the tightening device can be turned to arrive thereto in an optimal attitude without problems or risks of rope wandering. In particular, the rope can in this way be guided to a rim of a pulley positioned in a compact manner, i.e. with its rotational plane parallel with the wall plane(s) of the car or the hoistway. This can be provided such that the rope section in question turns in the same particular space between said planes, whereby the rest of the ropes can be guided freely without compromising the optimality of the suspension arrangement in general. In this case, the compactness of the rope bundle is beneficial as it decreases the space requirements of the turning ropes, but also reduces problems with wandering as well. The turning angle may be 90 degrees, for instance. Preferably, the all the ropes turn in the defined manner maintaining their mutual positioning (parallel, at least substantially coplanar and adjacent in width direction), i.e. the whole rope bundle formed by said ropes turns around the longitudinal axis of the rope bundle.

In a further refined embodiment the elevator comprises one or more rope wheels having its plane of rotation parallel with the vertical side wall plane of the car and/or the vertical hoistway inner wall plane, which rope wheel is mounted on the car at the side thereof or separate from the car and positioned beside the vertical projection of the car, and around which rope wheel the rope turns such that the rope turns around an axis extending in width-direction of the rope.

In a further refined embodiment the first and/or second rope section passes to the tightening device turning around its longitudinal axis in the space between the vertical projection of the car and the vertical hoistway inner wall plane. Thereby, the ropes in the space limited by wall planes of the car and hoistway have portions which do not have their width direction parallel with said planes.

In one preferred embodiment, alternative to the embodiment with a tightening pulley, the tightening member is in the form of a tightening lever mounted turnably via a pivot, the first and the second rope section each being fixed on the tightening lever, to pull the tightening lever by effect of the rope tension of the respective rope section to turn it in opposite turning directions, the first rope section being preferably fixed at a smaller distance from the pivot than the second rope section, thereby a leverage existing between them.

In a further refined embodiment the tightening device is mounted on the car or on the stationary hoistway structures.

In a preferred embodiment said first rope section is arranged to pass from the drive member to turn under rope wheel(s) mounted on the car, and to suspend the car via said rope wheel(s), and in that said second rope section is arranged to pass from the drive member to turn over rope wheel(s) mounted on the car, and further to the tightening device.

In a preferred embodiment the roping comprises exactly two of said ropes. Thus, the ropes are wide (as they are belt-like) and the number of ropes is small, which minimizes non-bearing clearances between adjacent ropes. Accordingly, the width of the individual ropes and the overall space required by the rope bundle is utilized very effectively for load bearing function. As a result, the wheels the ropes meet can be made compact in axial direction, but also the rope bundle arriving them consumes little space. Thus, they will fit well in a space between the car wall plane and the hoistway wall plane, even when this space is very slim. Having two ropes facilitates safety of the elevator as in this way it is not relied on only one rope.

In a preferred embodiment said load bearing member(s) is/are embedded in a common elastomeric coating. The ropes being belt-like, they provide an large surface area enabling efficient force transmission, e.g. by frictional engagement. This can be facilitated by elastomeric coating. In a preferred embodiment, the coating forms the contoured shape for the rope.

In a preferred embodiment said rope(s) each comprise a plurality of parallel load bearing members adjacent and spaced apart in the width direction of the belt-shaped rope.

In a preferred embodiment said the width/thickness ratio(s) of the rope is at least 4, preferably at least 8. Thereby, the bending resistance of the rope is small but the load bearing total cross sectional area can be made vast.

In a preferred embodiment said the width/thickness ratio(s) of said load bearing member(s) is/are at least 8, preferably more. Thereby, the bending resistance of the rope is small but the load bearing total cross sectional area is vast with minimal non-bearing areas.

In a further refined embodiment said load bearing member(s) has/have width larger than thickness as measured in width direction of the belt-like rope. In a yet further refined embodiment each of said rope(s) comprises a small number of load bearing parts, which is enabled by the great width. In one preferred embodiment, each of said rope(s) comprise(s) exactly one of said load bearing members. Thus, non-bearing cross sectional areas are minimized. Accordingly, the width of the rope is effectively utilized and size of the rope bundle minimized. In a preferred alternative embodiment, each of said rope(s) comprise exactly two of said load bearing members adjacent in width-direction of the rope. Thus, non-bearing areas between adjacent load bearing members are minimized, yet not having to rely on only one load bearing member. Said two load bearing members are parallel in length direction of the rope and placed on the same plane in width-direction of the rope.

In a preferred embodiment the of the elevator the thickness of each of said load bearing member(s) is from 0.8 mm to 1.5 mm, preferably from 1 mm to 1.2 mm as measured in thickness direction of the rope. In this way, the ropes as specified above, will have an optimal combination of properties with regard to compactness, traction abilities and tensile properties, which is especially important in case of an elevator where the ropes pass around a wheel is positioned in a slim space, in particular between the car wall plane and the hoistway inner wall plane as specified above. Preferably, the width of the of the single load bearing member or the total width of the two load bearing members of the same rope is from 20 mm to 30 mm. Preferably, the total width of the load bearing members of the two ropes is from 40 to 60 mm. This is the optimal combination of dimensions for obtaining an elevator with high maximum load and space efficiency.

In a further refined embodiment the load bearing member(s) of the rope cover(s) majority, preferably 70% or over, more preferably 75% or over, most preferably 80% or over, most preferably 85% or over, of the width of the rope. In this way at least majority of the width of the rope will be effectively utilized and the rope can be formed to be light and thin in the bending direction for reducing the bending resistance.

In a further refined embodiment the module of elasticity (E) of the polymer matrix is over 2 GPa, most preferably over 2.5 GPa, yet more preferably in the range 2.5-10 GPa, most preferably of all in the range 2.5-3.5 GPa. In this way a structure is achieved wherein the matrix essentially supports the reinforcing fibers, in particular from buckling. One advantage, among others, is a longer service life.

In a further refined embodiment, individual reinforcing fibers are homogeneously distributed in said polymer matrix. Preferably, over 50% of the cross-sectional square area of the load-bearing part consists of said reinforcing fiber. Preferably, the load-bearing part(s) cover(s) over proportion 50% of the cross-section of the rope. Thereby, a high tensile stiffness can be facilitated.

Preferably, said first rope section and a second rope section are connected to the car with same suspension ratio. Preferably, the elevator comprises a drive machine comprising said rotatable drive member and a power source, such as an electric motor, for rotating the drive member. Preferably, the rotatable drive member is positioned in the hoistway. The elevator as describe anywhere above is preferably, but not necessarily, installed inside a building. The car is preferably arranged to serve two or more landings. The car preferably responds to calls from landing and/or destination commands from inside the car so as to serve persons on the landing(s) and/or inside the elevator car. Preferably, the car has an interior space suitable for receiving a passenger or passengers, and the car can be provided with a door for forming a closed interior space.

BRIEF DESCRIPTION OF THE DRAWINGS

In the following, the present invention will be described in more detail by way of example and with reference to the attached drawings, in which.

DETAILED DESCRIPTION

Figure 1:
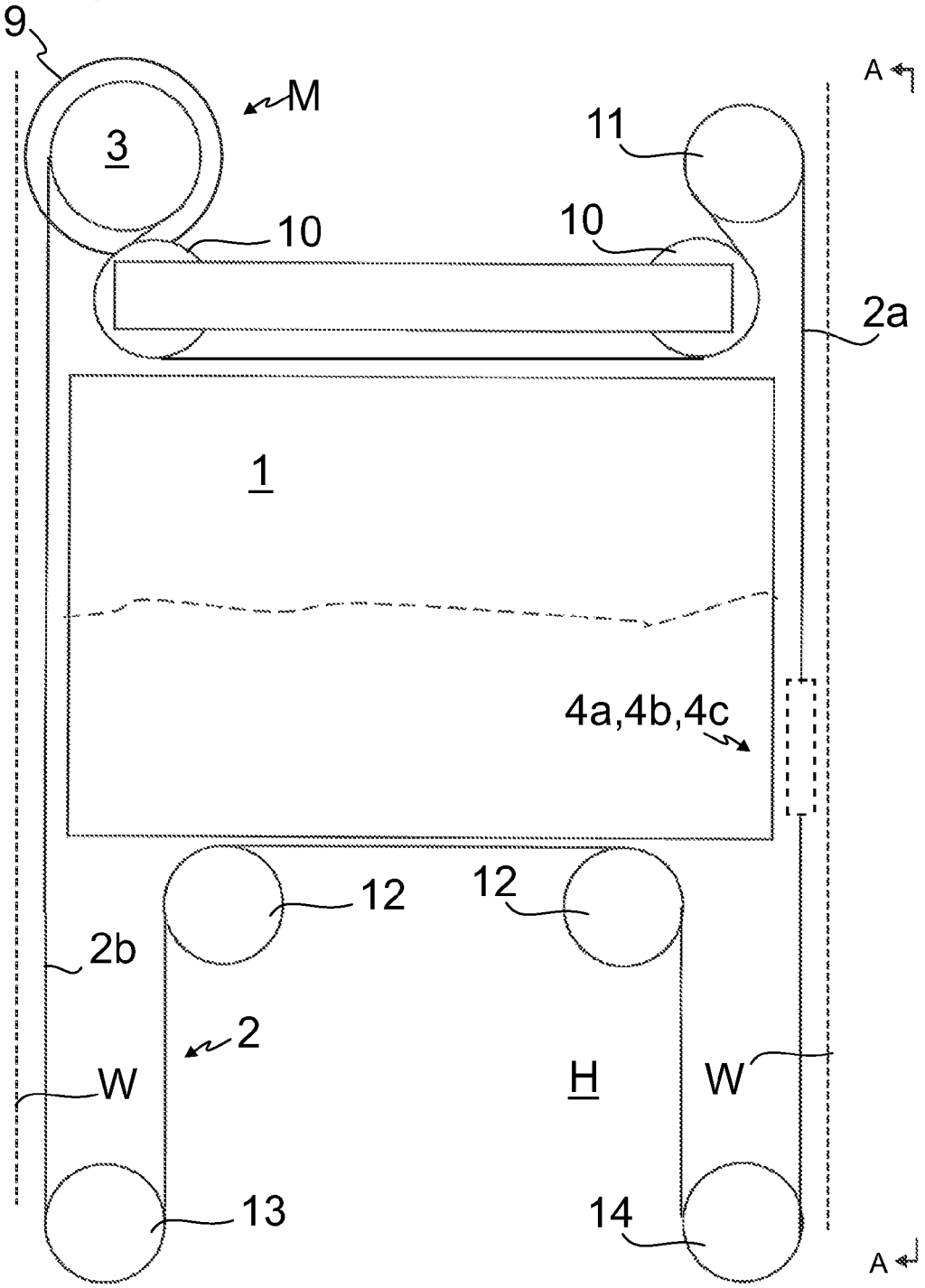
FIG. 1 illustrates schematically an elevator according to a first embodiment of the invention.
Figure 3:
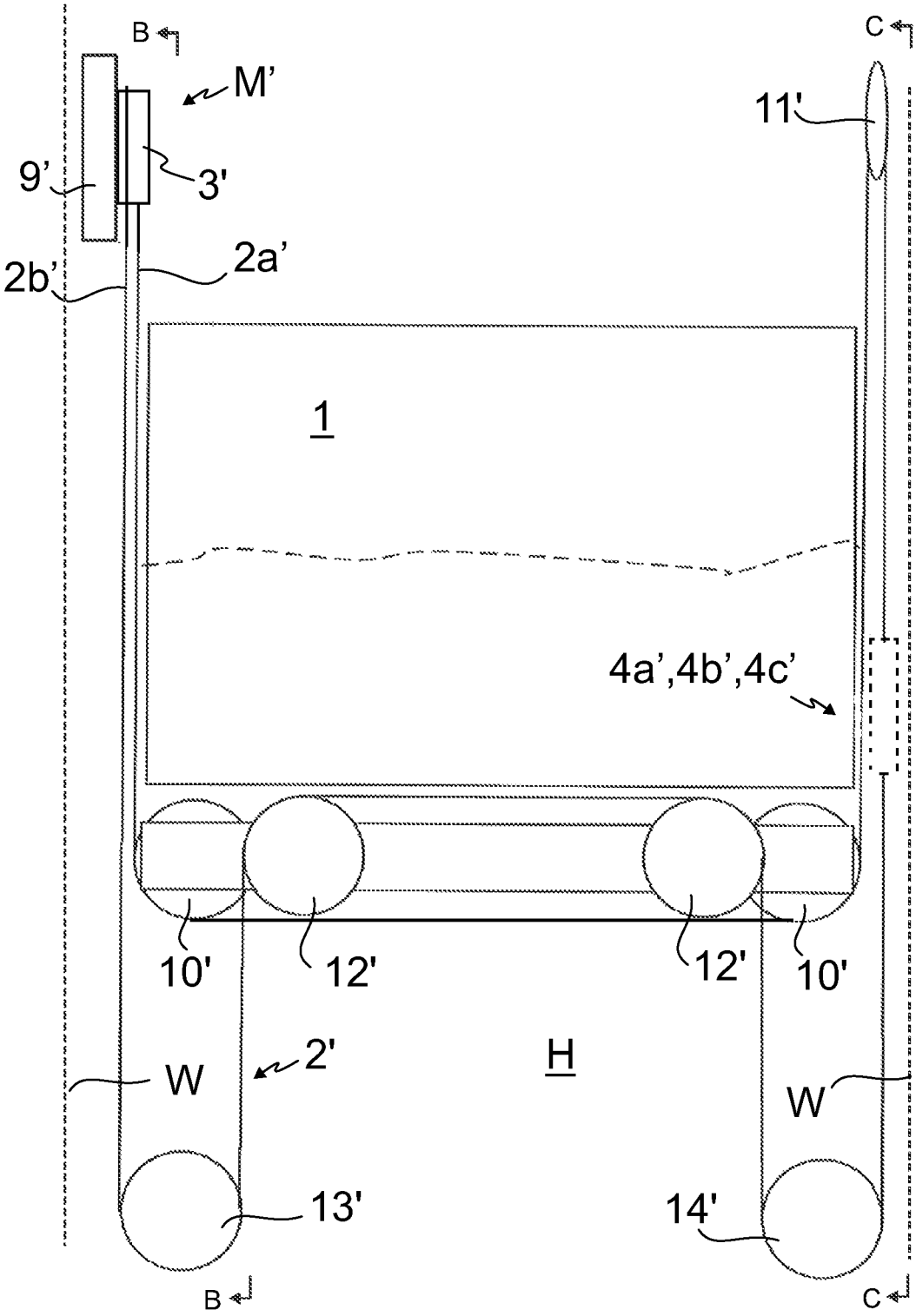
FIG. 3 illustrates schematically an elevator according to a second embodiment of the invention.
Figure 4:
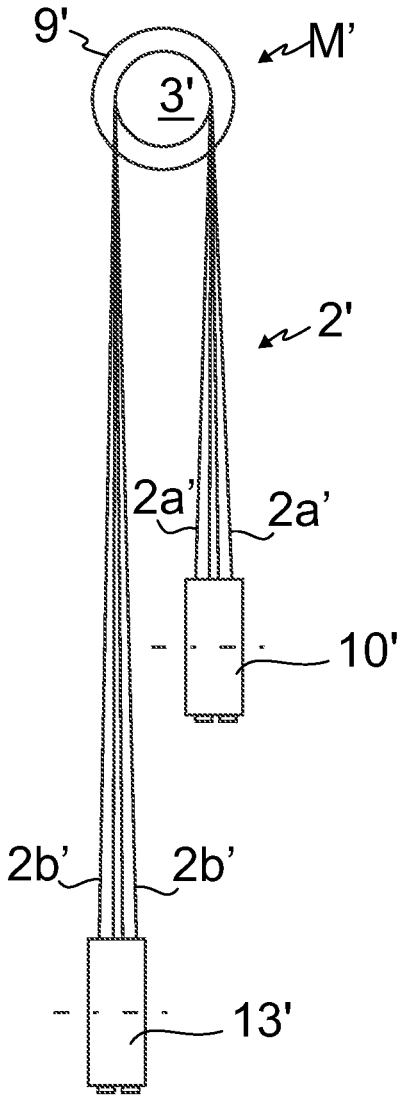
FIG. 4 illustrates view B-B of FIG. 3.

FIGS. 1 and 3 illustrate a counterweightless elevator according to a preferred embodiment. The elevator comprises a hoistway H, an elevator car 1 vertically movable in the hoistway H, and a drive machine M,M' which drives the elevator car 1 under control of an elevator control system (not shown). The drive machine M,M' is in these cases located in the top part of the hoistway H. It comprises a motor 9,9' and a rotatable drive member 3,3' engaging one or more suspension ropes 2,2' passing around the rotatable drive member 3,3' and which are connected to the car 1. Thus, driving force can be transmitted from the motor 9,9' to the car 1 via the rotatable drive member 3,3' and the suspension ropes 2,2'. The rotatable drive member 3,3' is in these embodiments in the form of a drive wheel. Said one or more suspension ropes 2,2' may comprise only one suspension rope, but preferably comprises a plurality of parallelly oriented suspension ropes as illustrated in the Figures. Each of the suspension rope(s) 2,2' have a first rope section 2*a*, 2*a'* on the first side of the drive member 3,3' and a second rope section 2*b*, 2*b'* on the second side of the drive member 3,3', each rope section 2*a*,2*b* being connected to the car 1, said first rope section 2*a*,2*a'* suspending the car 1. The elevator further comprises a tightening device 4 arranged to tighten the second rope section 2*b*, 2*b'*. Thus, the second rope section 2*b*, 2*b'* can be maintained tight. Each of said rope(s) 2,2' is belt-like and comprises a load bearing member 7,7' or a plurality of load bearing members 7,7', which load bearing member(s) 7,7' is/are made of composite material comprising reinforcing fibers f in a polymer matrix m, which reinforcing fibers f are carbon fibers. Due to this kind of overall cross sectional shape, structure and material selection of the hoisting rope 2,2', the simplicity of the roping containing said hoisting ropes 2,2' can be facilitated, in particular because the number of ropes as well as the cross sectional space consumption of the rope bundle can be reduced. Importantly, due to this kind of overall cross sectional shape, internal structure and material selection of each rope, the tightening capacity of the tightening device 4*a*,4*b*,4*c*;4*a'*,4*b'*,4*c'* can be reduced, most importantly due to excellent capability to provide high longitudinal stiffness with compact structure. The tightening device 4*a*,4*b*,4*c*;4*a'*, 4*b'*,4*c'* can therefore be designed to be simple and compact. Carbon fiber as a material provides the load bearing members 7,7' good stiffness, but for maximizing the longitudinal stiffness of the rope, said load bearing member(s) 7,7' is/are preferably parallel with the longitudinal direction of the rope and said reinforcing fibers f are parallel with the longitudinal direction of the load bearing member 7,7' as far as possible. Thus an untwisted, and thereby in longitudinal direction a structure with high tensile stiffness is obtained.

In the elevator shown in FIG. 1, the first rope section 2*a* of each rope 2 is arranged to pass from the drive member 3 mounted to rotate in a stationary position to the elevator car 1, in particular to turn under rope wheels 10 mounted on the car 1, and to thereby suspend the car via said rope wheels 10. The rope(s) 2 are guided further to pass over a rope wheel 11 mounted to rotate in a stationary position. The second rope section 2*b* is arranged to pass from the drive member 3 to turn over rope wheels 12 mounted on the car 1. Thereby, the second rope section 2*b* is arranged to travel along with the car 1 thereby not piling up anywhere in the hoistway H during car movement. The second rope section 2*b* is further guided to the tightening device 4*a*,4*b*,4*c*, which is arranged to further tighten the second rope section 2*b*. In this way, the rope tension of the rope section 2*b* not suspending the car is increased, whereby it is ensured that the rope rests against the rotatable drive member 3 firmly for the whole length of contact between these components, in particular so that a normal force adequate for providing firm engagement between these components is effected. In this way, also the reduction of rope tension caused by changes of rope length occurring e.g. as a function of car position or load changes, can in this way be eliminated. Thereby, also likelihood of ropes 2 jumping away from their guide wheels 12,13 can be reduced.

Figure 2A:
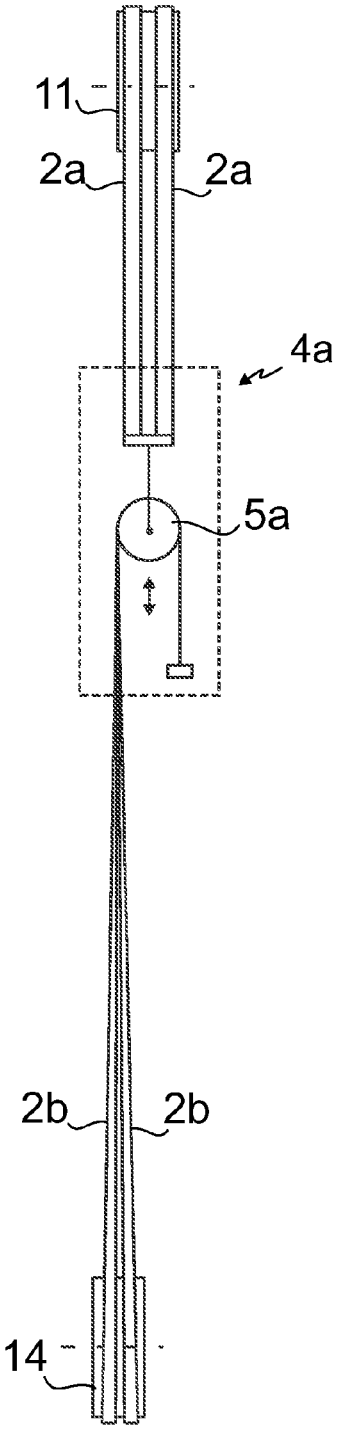
FIGS. 2*a*-2*c* illustrate view A-A of FIG. 1, each illustrating a preferred alternative structure for the elevator of FIG. 1.
Figure 2B:
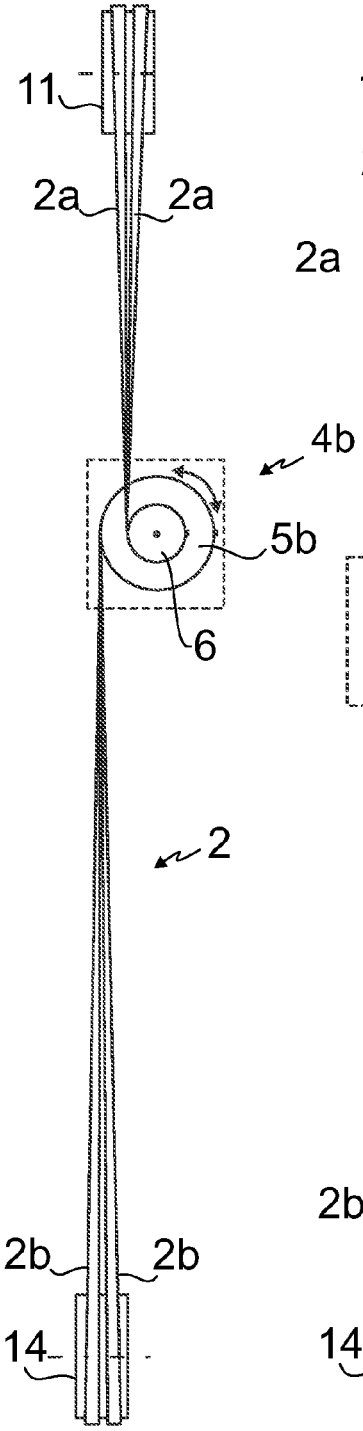
Figure 2C:
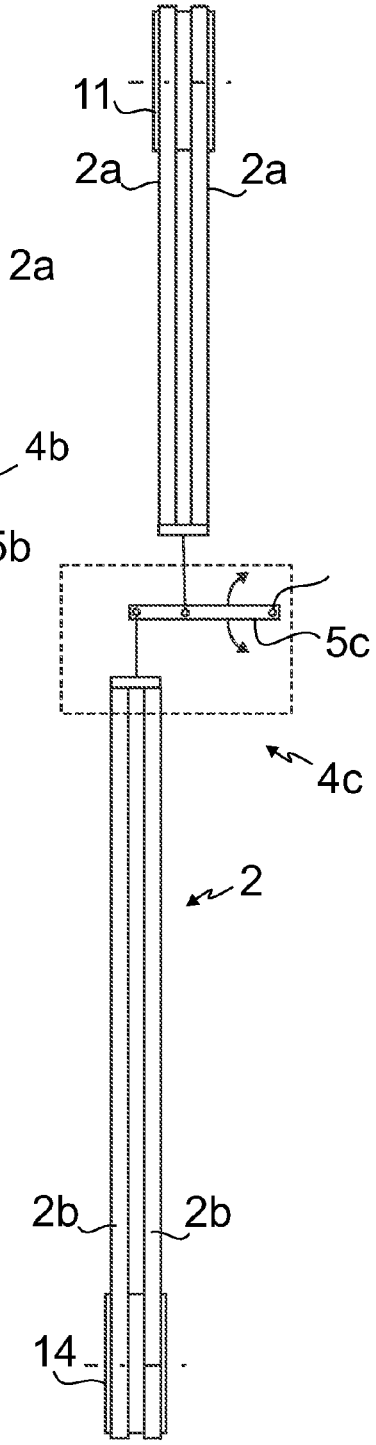

In the illustrated embodiment the first rope section 2*a* and the second rope section 2*b* are connected to the car 1 with same (suspension) ratio, in this case with ratio 2:1 as these sections 2*a* and 2*b* of rope 2 are connected each to car 1 via only one set of rope wheels 10,12. The first rope section 2*a* on the first side of the drive member 3 passes from the drive member 3 to the car 1 forming a first rope loop, which suspends the car 1 via rope wheels 10 mounted on the car 1. The second rope section 2*b* on the second side of the drive member 3 passes to the car 1 forming a second rope loop, which is suspended by the car 1 via rope wheels 12 mounted on the car 1. The first rope loop suspending the car is formed between upper rope wheels 3,11 mounted at the upper end of the path of the car 1 and the second rope loop is formed between lower rope wheels 13,14 mounted at the lower end of the path of the car 1. In this embodiment, the rotational planes of all the rope wheels 2,10,12,13,14 and 11 are substantially coplanar, whereby each rope 2 passes along a plane without substantial twisting. The rope passes around all the rope wheels 2,10,12,13,14 and 11 turning around an axis extending in width-direction of the rope 2. For clarity in FIG. 1 the ropes 2 are illustrated as mere lines. FIGS. 2*a* to 2*c* illustrate preferred configuration of ropes 2 between rope wheels 11 and 14.

In the elevator shown in FIG. 3, the first rope section 2*a'* of each rope 2' is arranged to pass from the drive member 3' mounted to rotate in a stationary position to the elevator car 1, in particular to turn under rope wheels 10' mounted on the car 1, and to thereby suspend the car 1 via said rope wheels 10'. The rope(s) 2' are guided further upwards to pass over a rope wheel 11' mounted to rotate in a stationary position. The second rope section 2*b*' is arranged to pass from the drive member 3' to turn over rope wheels 12' mounted on the car 1. Thereby, the second rope section 2*b*' is arranged to travel along with the car 1 thereby not piling up anywhere in the hoistway H during car movement. The second rope section 2*b*' is further guided to the tightening device 4*a*',4*b*', 4*c*', which is arranged to further tighten the second rope section 2*b*'. In this way, the rope tension of the rope section 2*b*' not suspending the car is increased, whereby it is ensured that the rope 2' rests against the rotatable drive member 3' firmly for the whole length of contact between these components, in particular so that a normal force adequate for providing firm engagement between these components is effected. In this way, also the reduction of rope tension caused by changes of rope length occurring e.g. as a function of car position or load changes, can in this way be eliminated. Thereby, also likelihood of ropes 2' jumping away from their guide wheels 12',13' can be reduced.

In the illustrated embodiment the first rope section 2*a*' and the second rope section 2*b*' are connected to the car 1 with same (suspension) ratio, in this case with ratio 2:1, as rope sections 2*a*' and 2*b*' of rope 2' are connected each to car 1 via only one set of rope wheels 10',12'. The first rope section 2*a*' on the first side of the drive member 3' passes from the drive member 3' to the car 1 forming a first rope loop, which suspends the car 1 via rope wheels 10' mounted on the car 1. The second rope section 2*b*' on the second side of the drive member 3' passes to the car 1 forming a second rope loop, which is suspended by the car 1 via rope wheels 12' mounted on the car 1. The first rope loop suspending the car is formed between upper rope wheels 3',11' mounted at the upper end of the path of the car 1 and the second rope loop between the lower rope wheels 13',14' mounted at the lower end of the path of the car 1.

In this embodiment, the rotatable drive member 3', as well as the power source 9', is positioned beside the vertical projection of the car 1, so as to enable extending the path of the car 1 as far as possible towards shaft end in a space efficient manner. Particularly preferably, the rotatable drive member 3' is positioned in the hoistway space which is between a hoistway wall and the vertical projection of the car. For this purpose, the rotatable drive member 3', as well as the power source 9' (e.g. electric motor), have rotational plane which is parallel with the side wall plane of the car 1 (i.e. the plane coplanar with the planar side wall of the car 1) and/or hoistway inner wall plane. The rope wheels 10',13' where the rope 2 is guided from the rotatable drive member 3' have each an axis of the rotation which is orthogonal with respect to the axis of rotation of the rotatable drive member 3'. Therefore, the ropes 2 pass downwards to these rope wheels each rope 2 turning around its longitudinal axis an angle of 90 degrees.

Figures 5A, 5B, 5C:
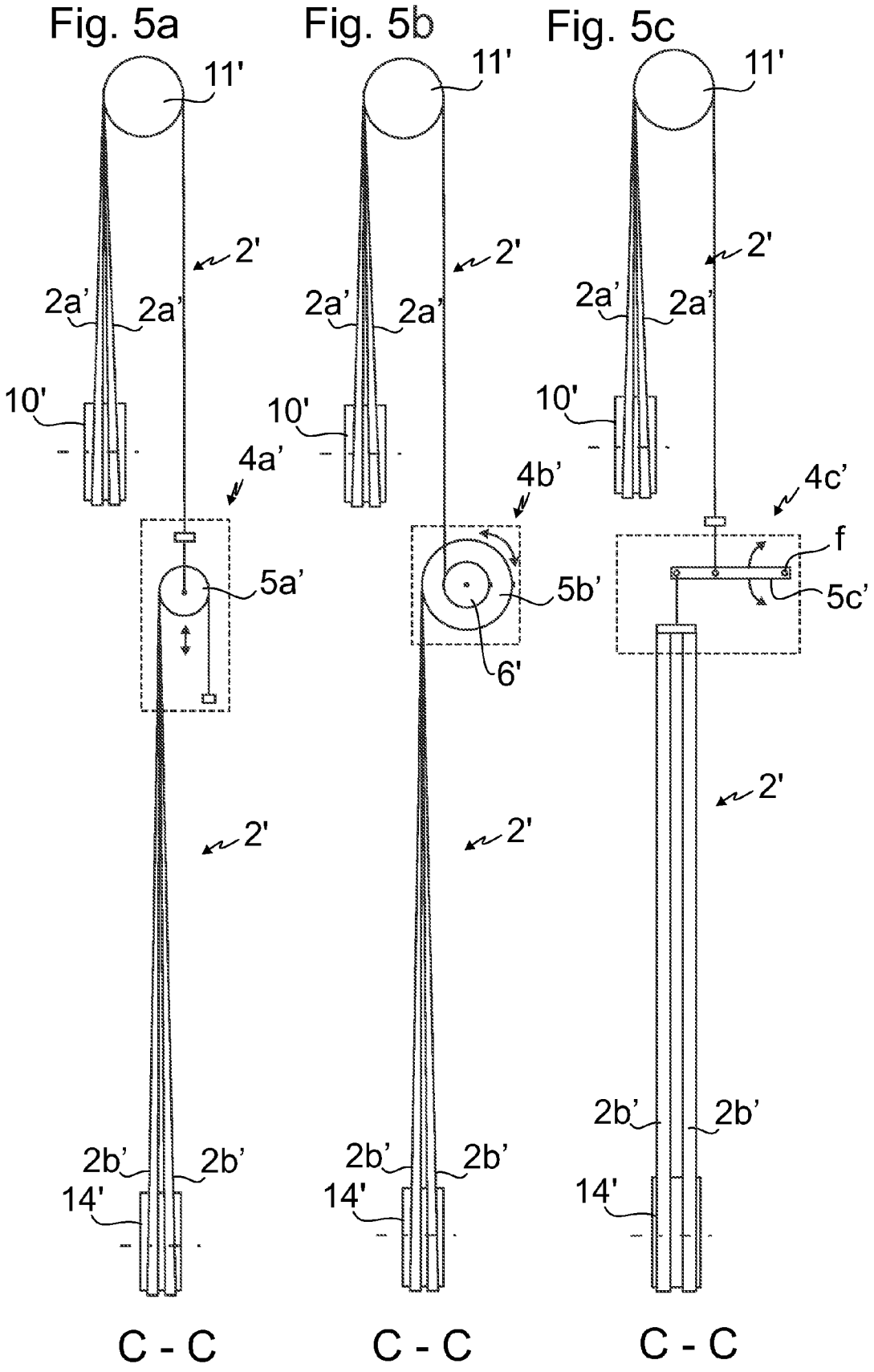
FIGS. 5*a*-5*c* illustrate view C-C of FIG. 3, each illustrating a preferred alternative structure for the elevator of FIG. 1.

FIGS. 2*a* to 2*c* represent alternative tightening devices in context of elevator as illustrated in FIG. 1. FIGS. 5*a* to 5*c* represent alternative tightening devices, with corresponding tightening principles as in FIGS. 2*a* to 2*c* but in context of elevator as illustrated in FIG. 3. In each case, the second rope section 2*b*,2*b*' is connected to a movably mounted tightening member 5*a*,5*b*,5*c*;5*a*',5*b*',5*c*' of the tightening device 4*a*,4*b*,4*c*;4*a*',4*b*',4*c*' of the second rope section 2*b*,2*b*', which tightening member is movable to tighten the second rope section 2*b*,2*b*'. This movement is needed for tightening the second rope section 2*b*,2*b*'. The range of this movement may be dimensioned short/small when the rope 2,2' is of the structure as above described, and thereby stiff in its longitudinal direction. The range of movement is relevant for the size of the tightening device, as well as simplicity of the system. Thus, the tightening device can be made more simple and small thanks to the ropes 2,2' stiff in their longitudinal direction. Thereby, it can also be ensured that the range of movement is adequate, which could be difficult especially in elevators where lifting height is great, those elevators thereby have strong rope elongation caused by changes in load and/or car position.

In each case, the elevator works fine if the tightening device 4*a*,4*b*,4*c*;4*a*',4*b*',4*c*' is mounted either on the car 1 at the side thereof, or separate from the car (e.g. on the stationary hoistway structures) to be positioned beside the vertical projection of the car 1 (in the illustrated case particularly beside the path of the elevator car 1). In each of the presented cases, the tightening member 5*a*,5*b*,5*c*;5*a*',5*b*', 5*c*' is movable along a plane, which is parallel with the side wall plane of the car and/or hoistway inner wall plane to tighten the second rope section 2*b*,2*b*', whereby the tightening movement does not necessitate large hoistway space beside the path of the elevator car 1.

In the preferred embodiments, the movable tightening member 5*a*,5*b*,5*c*;5*a*',5*b*',5*c*' connects the first rope section 2*a*,2*a*' and the second rope section 2*b*,2*b*' in a force transmitting manner to each other. In particular, said first rope section 2*a*,2*a*' suspending the car is tensioned by the weight of the car 1, and guided to pass further to said tightening device 4*a*,4*b*,4*c*;4*a*',4*b*',4*c*' of the second rope section 2*b*,2*b*' and connected in a force transmitting manner to said a movably mounted tightening member to pull the tightening member 5*a*,5*b*,5*c*;5*a*',5*b*',5*c*' by effect of the rope tension of the first rope section 2*a*,2*a*' such that the tightening member 5*a*,5*b*,5*c*;5*a*',5*b*',5*c*' moves to tighten the second rope section 2*b*. Thereby, tension caused by the car 1 can be utilized to tighten the second rope section 2*b*,2*b*', i.e. to provide more tension for it. This is implemented in the preferred embodiments such that the end of the first rope section 2*a*,2*a*' is connected in a force transmitting manner, e.g. fixed, to the movably mounted tightening member 5*a*,5*b*,5*c*;5*a*',5*b*',5*c*' to pull the tightening member 5*a*,5*b*,5*c*;5*a*',5*b*',5*c*' by effect of the rope tension of the first rope section 2*a*,2*a*' such that the tightening member 5*a*,5*b*,5*c*;5*a*',5*b*',5*c*' moves to tighten the second rope section 2*b*,2*b*'.

In the embodiments as illustrated, the tightening member 5*a*,5*b*,5*c*;5*a*',5*b*',5*c*' is movable to tighten the second rope section 2*b*,2*b*' along a vertical plane, which is parallel with the vertical side wall plane of the car and/or the vertical hoistway inner wall plane W, in particular between the vertical side wall plane of the car and/or the vertical hoistway inner wall plane W. For this reason it is important that the rope bundle is compact in the direction of the horizontal distance between these two planes. The aforementioned movement occurring along said plane, which is parallel with the side wall plane of the car and/or hoistway inner wall plane, is in particular turning movement and/or linear movement.

FIGS. 2*a*, 2*b*, 5*a*, 5*b* each discloses a preferred embodiment where the tightening member 5*a*,5*b*;5*a*',5*b*' is in the form of a tightening pulley around which the second rope section 2*b*,2*b*' passes. The plane of rotation of the tightening pulley 5*a*,5*b*;5*a*',5*b*' is preferably parallel with the side wall plane of the car 1 and/or hoistway inner wall plane W, as illustrated. This is because the tightening pulley can be made more compact in its axial direction than radial direction. This is particularly important when tightening pulley 5*a*,5*b*; 5*a*',5*b*' is positioned between the vertical side wall plane of the car and/or the vertical hoistway inner wall plane W, as in this way the structure thereof nor the ropes arriving to or leaving it form an obstacle for the elevator car.

The embodiments as illustrated in FIGS. 2*a* and 5*a* share the principle of tightening. The tightening member 5*a*;5*a*' is in these embodiments a tightening pulley around which the second rope section 2*b*,2*b*' passes, which tightening pulley is movable in radial direction of the tightening pulley, as illustrated with an arrow, to tighten the second rope section 2*b*. The pulley is in particular an idle pulley, so it can furthermore turn around its axis in addition to said radial movement, and thereby adapt to movement of the rope along its circumference. The second rope section 2*b*,2*b*' passes further to a rope fixing where the end of the second rope section 2*b*,2*b*' is fixed. Said first rope section 2*a*,2*a*' suspending the car 1 is connected in a force transmitting manner to the movably mounted tightening pulley to pull the tightening pulley by effect of the rope tension of the first rope section such that the tightening pulley moves radially to tighten the second rope section (i.e. such that the second rope section is tightened). This is implemented by fixing the end of the first rope section 2*a*,2*a*' to the movably mounted tightening pulley 5*a*;5*a*'.

Likewise, the embodiments as illustrated in FIGS. 2*b* and 5*b* share the principle of tightening. The tightening member 5*b*; 5*b*' is in these embodiments movable by turning around its axis, as illustrated with an arrow, to tighten the second rope section 2*b*,2*b*'. The tightening member 5*b*,5*b*' is in the form of a tightening pulley around which the second rope section 2*b*,2*b*' passes and against the rim of which the second rope section is fixed (the fixing point marked with black dot), the tightening member 5*b*,5*b*' being movable around its axis to tighten the second rope section 2*b*,2*b*'. The end of the first rope section 2*a*,2*a*' is connected in a force transmitting manner to the movably mounted tightening pulley 5*b*,5*b*' to pull the tightening pulley by effect of the rope tension of the first rope section such that the tightening pulley turns to tighten the second rope section such that the second rope section is tightened. In particular, the end of the first rope section 2*a*,2*a*' is connected in a force transmitting manner to the movably mounted tightening pulley via a transmission pulley 6,6' comprised in the tightening device 4*c*, which transmission pulley 6,6' is movable around its axis fixedly and coaxially with the tightening pulley 5*b*,5*b*', around which transmission pulley 6,6' the second rope section 2*b*,2*b*' passes and against the rim of which the first rope section 2*a*,2*a*' is fixed (the fixing point marked with black dot). The first and second rope sections 2*a*,2*a*',2*b*,2*b*' are arranged to pass around their pulleys such that they pull the tightening pulley 5*b*,5*b*' by effect of the rope tension to turn it in opposite turning directions. The tightening pulley 5*b*,5*b*' is preferably larger in diameter than the transmission pulley 6,6', whereby a leverage (of ratio other than 1) exists between them. Thereby the ratio of the tension T1 (of the first rope sections 2*a*,2*a*')/tension T2 (of the second rope section 2*b*,2*b*') can be set to be more or less than 1, most preferably from 1.5 to 2.5.

Likewise, the embodiments as illustrated in FIGS. 2*c* and 5*c* share a principle of tightening. In these embodiments, the tightening member 5*c*,5*c*' is in the form of a tightening lever mounted turnably via a pivot f, the first and the second rope section 2*a*,2*b*;2*a*',2*b*' each being fixed on the tightening lever 5*c*', to pull the tightening lever 5*c*' by effect of the rope tension of the respective rope section to turn it in opposite turning directions. The first rope section 2*a*,2*a*' is fixed at a smaller distance from the pivot f than the second rope section 2*b*,2*b*', thereby a leverage (of ratio other than 1) existing between them. Thereby, the ratio tension T1 (of the first rope sections 2*a*,2*a*')/tension T2 (of the second rope section 2*b*,2*b*') can be set to be lower or higher than 1, most preferably from 1.5 to 2.5.

The elevator comprises preferably a plurality, most preferably exactly two (not more nor less) of said ropes 2,2'. These ropes 2,2' pass around a number of wheels 3,5*a*,5*b*, 10,11,12,13,14,3',5*a*',5*b*',10',11',12',13',14' of the elevator adjacent each other in width-direction of the rope 2,2', parallelly and at least substantially coplanar, the wide sides of the belt-like ropes 2,2' against the wheels in question, said wheels 3,5*a*,5*b*,10,11,12,13,14,3',5*a*',5*b*',10',11',12', 13',14' preferably including at the rotatable drive member in the form of a wheel 3,3'.

Figure 6A:
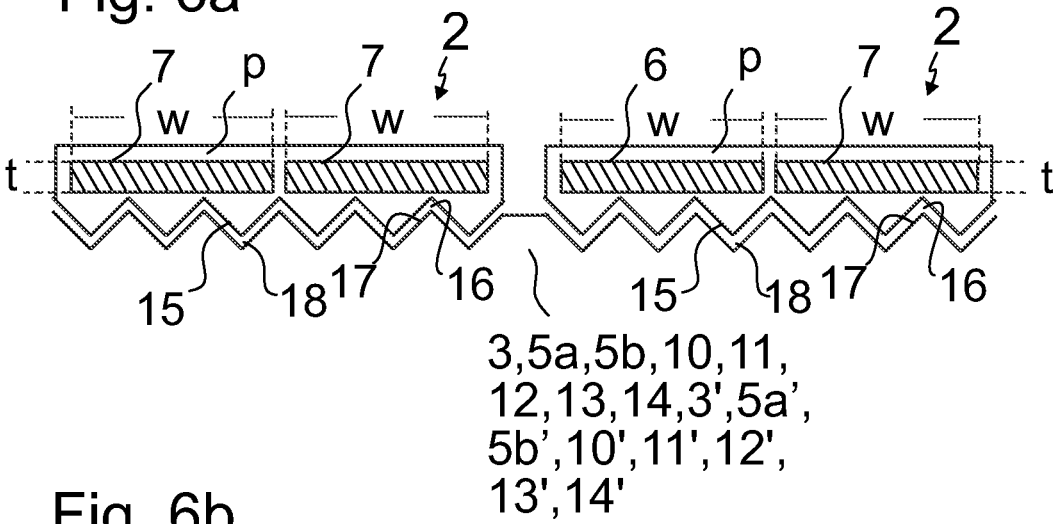
FIGS. 6*a* and 6*b* illustrate preferred alternative structures of the ropes.
Figure 6B:
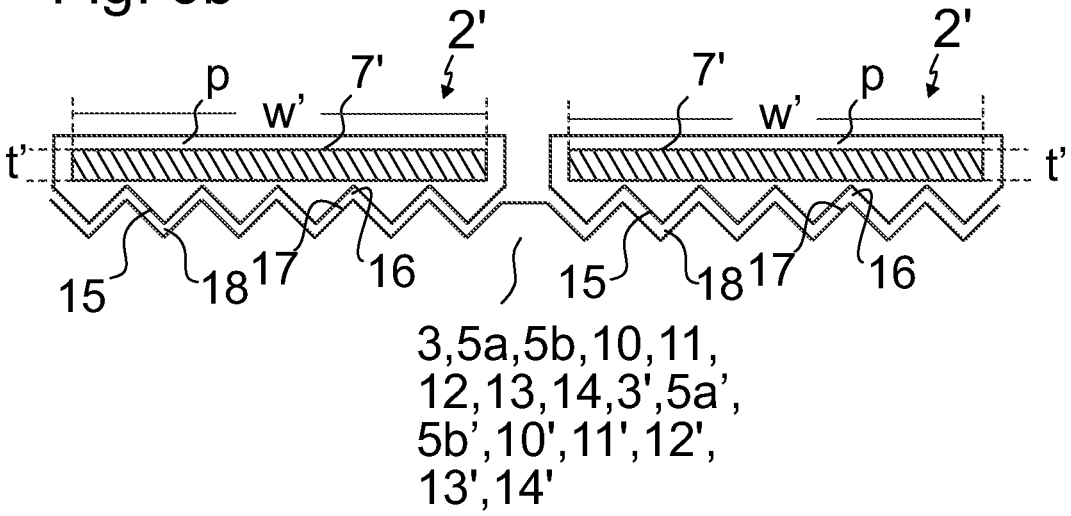

FIGS. 6*a* and 6*b* disclose preferred cross-sectional structures for the ropes 2,2' as well as their preferred configuration relative to each other in the roping. The figures illustrate further a preferred surface shape for the ropes as well as the wheels 3,5*a*,5*b*,10,11,12,13,14,3',5*a*',5*b*',10',11',12',13',14' of the elevator, around which wheels the ropes 2,2' pass. In FIGS. 6*a* and 6*b*, the elevator comprises only these two ropes 2,2'. Each rope 2 as illustrated in FIG. 3*a* comprises one load bearing member 15 for transmitting force in the longitudinal direction of the rope 2 and the rope 2' as illustrated in FIG. 3*b* comprises a plurality, in particular two, load bearing members 7,7' for transmitting force in the longitudinal direction of the rope 2'. The preferred internal structure for the load bearing member(s) 7,7' is disclosed elsewhere in this application, in particular in connection with FIG. 2.

The load bearing members 7,7' of each rope is/are embedded in a common elastomeric coating p, which is preferably of polymer, most preferably of polyurethane, which coating p forms the surface of the rope 2,2'. In this way, it provides the surface for contacting the wheels around which the rope 2,2' passes, for example the drive wheel 3,3'. The coating p provides the rope protection and good frictional properties for force transmittance via the drive wheel 3,3'. The coating p can be also used for providing a contoured shape for the rope. For facilitating the formation of the load bearing member 7,7' and for achieving constant properties in the longitudinal direction it is preferred that the structure of the load bearing member 7,7' continues essentially the same for the whole length of the rope 2,2'. For the same reasons, the structure of the rope 2,2' continues preferably essentially the same for the whole length of the rope 2,2'.

As mentioned, the ropes 2,2' are belt-shaped. The width/thickness ratio of each rope 2,2' is preferably at least 4, but preferably at least 8 or more. In this way a large cross-sectional area for the rope 2,2' is achieved, such that the bending capacity is good around an axis extending in width direction of the rope, also with rigid materials of the load bearing member 7,7'. The load bearing member 7' or a plurality of load bearing members 7 together cover most, preferably 80% or more, of the total width of the cross-section of the rope 2,2' for essentially the whole length of the rope. Thus the supporting capacity of the rope 2,2' with respect to its total lateral dimensions is good, and the rope does not need to be formed to be thick. This is preferably implemented with the composite as specified elsewhere in the application and this is particularly advantageous from the standpoint of, among other things, compactness of the rope bundle, total load bearing ability, service life and bending rigidity.

The two adjacent ropes 2 of FIG. 6*a* comprise each two load bearing members 7 of the aforementioned type adjacent in width-direction of the rope 2,2'. They are parallel in longitudinal direction, spaced apart in the width direction of the belt-shaped rope 2 and on essentially the same plane relative to each other. Thus the resistance to bending around an axis extending in the width direction of the rope 2 is small. The load bearing members 7 are in one suitable example of this configuration each 1.1 mm thick as measured in thickness direction of the rope 2, and 12 mm wide as measured in width direction of the rope 2.

The ropes 2' of FIG. 6*b* comprise each only one load bearing member 7' of the aforementioned type. The load bearing members 7' are in one suitable example of this configuration each 1.1 mm thick as measured in thickness direction of the rope 2, and 25 mm wide as measured in width direction of the rope 2.

As mentioned earlier, it is preferable the load bearing member(s) 7,7' have/has width (w,w') larger than thickness (t,t') thereof as measured in width-direction of the rope 2,2'. In particular, the width/thickness ratio(s) of each of said load bearing member(s) 7,7' is/are at least 8, preferably more. In this way a large cross-sectional area for the load bearing member/members is achieved, without weakening the bending capacity around an axis extending in the width direction. So as to achieve an extremely compact and yet working solution for an elevator the thickness t,t' of each of said load bearing member(s) 7,7' is from 0.8 mm to 1.5 mm, preferably from 1 mm to 1.2 mm as measured in thickness direction of the rope 2,2'. The width w' of the of the single load bearing member 7' or the total width w+w of the two load bearing members 7 of the same rope 2,2' is not more than 30 mm, preferably from 20 mm to 30 mm. In this way the rope 2,2' is made very small in all directions and it will fit to very small space to bend in reasonable radius. The total width (w+w, w') of the of the load bearing members 7,7' of all the ropes 2,2' of the rope bundle is 40-60 mm. In this way the total width of the rope bundle can be even smaller than what is achieved with metal ropes, yet the tensile strength and rigidity properties of the roping is at same level and the bending radius is not too great for producing torque in compact manner. There are two ropes, thus making the roping safer not relying on merely one larger rope. In this way, a redundant roping is obtained.

Each rope 2, 2' presented in FIGS. 6*a* and 6*b* comprises one load bearing member 7' or a plurality of load bearing members 7 adjacent each other in width-direction of the rope 2,2'. In this way the space consumption the total bundle of the ropes 2,2' is reduced. The ropes being belt-like they have a width greater than the thickness. In the preferred embodiments, the ropes 2, 2' are placed to pass in the space between vertical side wall plane of the car 1 and the vertical hoistway inner wall plane W. Also, there are wheels 3',5*a*,5*b*,5*a*',5*b*', 6,6',11' are placed to pass in the space between vertical side wall plane of the car 1 and the vertical hoistway inner wall plane W such that the rotation plane of the wheel is at least substantially parallel to vertical side wall plane of the car 1 and the vertical hoistway inner wall plane W. Thereby, the belts 2,2' pass such that their large dimensions are in the direction in which the space consumption needs to be minimized, i.e. in the direction of distance between the vertical side wall plane of the car 1 and the vertical hoistway inner wall plane W. This is compensated for by designing the roping such that the bearing cross section of the rope bundle and inner structure of its each rope 2,2' is maximized. Said one load bearing member 7' or each of said plurality of load bearing members 7 has width w, w' substantially larger than thickness t, t' thereof as measured in width-direction of the rope 2,2'. This means that each load bearing member 15 is constructed wide. Due to this, small number of load bearing members can be used, thus minimizing non-bearing areas between adjacent load bearing members 7,7'. Accordingly, the width of each rope 2, 2' is utilized very effectively for load bearing function. Furthermore, ropes 2,2' are made wide and the number of ropes small, which minimizes the number of non-bearing clearances between adjacent ropes 2, 2' of the roping. Accordingly, the total amount of non-bearing areas inside the roping is minimized. The load bearing members 7,7' are preferably made of composite material comprising reinforcing fibers f in a polymer matrix m, the reinforcing fibers being carbon fibers. In this way the load bearing members 7,7' can be made to have a very high tensile stiffness and tensile strength per unit area of cross section. To achieve a certain tensile strength and rigidity a bearing cross-sectional area is sufficient in case of carbon fiber composite, which is half of the cross-sectional area typically needed with metallic ropes. Thus, the space consumption of the wheel (in its axial direction) and the ropes passing around it (in their width direction) can be reduced even to less than 50 mm, yet maintaining the hoisting capacity high. The preferred inner structure of the rope is preferably constructed as will be later described.

In the embodiment of FIGS. 6*a* and 6*b* two ropes 2,2' pass around a wheel adjacent each other in width-direction of the rope 2 the wide sides of the ropes 2 against the wheel. In this case, the wide side is contoured and provided with guide ribs 15 and guide grooves 16 which are oriented in the longitudinal direction of the rope 2,2', and said contoured side is fitted to pass against a contoured circumference of the wheel, said contoured circumference being provided with guide ribs 17 and guide grooves 18 so that said contoured circumference forms a counterpart for said contoured sides of the ropes 2,2'. This provides the effect that the ropes 2,2' are guided very accurately in axial direction of the wheel(s). Thus, the wandering of the ropes 2,2' is small which facilitates that small distances between adjacent ropes 2,2' can be had very small as well as running clearances between the ropes 2,2'. In particular, the wandering, caused by rope twist, is efficiently eliminated in the embodiments of FIGS. 2*a*, 2*b*, 5*a* and 5*b* where the first or the second rope section 2*a*,2*b*;2*a*',2*b*' passes (downwards or upwards) from rope wheel 11,14;11',14' to the tightening device 4*a*,4*b*;4*a*',4*b*', in particular to a pulley thereof, turning around its longitudinal axis an angle. The angle is in these cases substantially 90 degrees.

Figure 7:
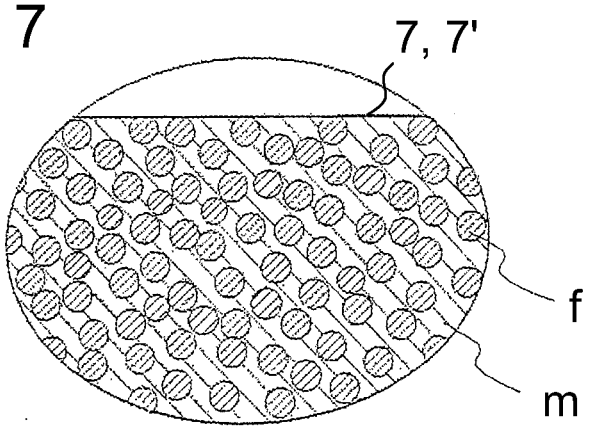
FIG. 7 illustrates a preferred internal structure for the load bearing part.

The bending direction of the rope 2,2' is around an axis that is in the width direction of the rope 2,2' as well as in width direction of the load bearing members 7,7' thereof (up or down in the FIGS. 6*a* and 6*b*). The inner structure of the load bearing member 7,7' is more specifically as follows. The inner structure of the load bearing member 7,7' is illustrated in FIG. 7. The load bearing member 7,7' as well as its fibers f are parallel with the longitudinal direction of the rope, as far as possible. Individual fibers are thus oriented in the longitudinal direction of the rope. In this case the fibers are aligned with the force when the rope is pulled. Thereby, the tensile stiffness of the load bearing members is maximized. Individual reinforcing fibers f are bound into a uniform load bearing member with the polymer matrix m. Thus, each load bearing member 7,7' is one solid elongated rodlike piece. The reinforcing fibers f are preferably long continuous fibers in the longitudinal direction of the rope 2,2', and preferably they continue for the distance of the whole length of the rope 2,2'. Preferably as many fibers f as possible, most preferably essentially all the fibers f of the load bearing member 7,7' are oriented in longitudinal direction of the rope. The reinforcing fibers f are in this case essentially untwisted in relation to each other, in particular in contrast to ropes of twisted structure. Thus the structure of the load bearing member can be made to continue the same as far as possible in terms of its cross-section for the whole length of the rope. The reinforcing fibers f are preferably distributed in the aforementioned load bearing member 7,7' as evenly as possible, so that the load bearing member 7,7' would be as homogeneous as possible in the transverse direction of the rope 2,2'. An advantage of the structure presented is that the matrix m surrounding the reinforcing fibers f keeps the interpositioning of the reinforcing fibers f essentially unchanged. It equalizes with its slight elasticity the distribution of a force exerted on the fibers, reduces fiber-fiber contacts and internal wear of the rope, thus improving the service life of the rope. The reinforcing fibers being carbon fibers, a good tensile rigidity and a light structure and good thermal properties, among other things, are achieved. They possess good strength properties and rigidity properties with small cross sectional area, thus facilitating space efficiency of a roping with certain strength or rigidity requirements. They also tolerate high temperatures, thus reducing risk of ignition. Good thermal conductivity also assists the onward transfer of heat due to friction, among other things, and thus reduces the accumulation of heat in the parts of the rope. The composite matrix m, into which the individual fibers f are distributed as evenly as possible, is most preferably of epoxy resin, which has good adhesiveness to the reinforcements and which is strong to behave advantageously with carbon fiber. Alternatively, e.g. polyester or vinyl ester can be used. Alternatively some other materials could be used. FIG. 7 presents a partial cross-section of the surface structure of the load bearing member 7,7' as viewed in the longitudinal direction of the rope 2,2', presented inside the circle in the figure, according to which cross-section the reinforcing fibers f of the load bearing members 7,7' are preferably organized in the polymer matrix m throughout the load bearing member 7,7' in question. As peresented by FIG. 7, the individual reinforcing fibers f are essentially evenly distributed in the polymer matrix m, which surrounds the fibers and which is fixed to the fibers f. The polymer matrix m fills the areas between individual reinforcing fibers f and binds essentially all the reinforcing fibers f that are inside the matrix m to each other as a uniform solid substance. In this case abrasive movement between the reinforcing fibers f and abrasive movement between the reinforcing fibers f and the matrix m are essentially prevented. A chemical bond exists between, preferably all, the individual reinforcing fibers f and the matrix m, one advantage of which is uniformity of the structure, among other things. To strengthen the chemical bond, there can be, but not necessarily, a coating (not presented) of the actual fibers between the reinforcing fibers and the polymer matrix m. The polymer matrix m is of the kind described elsewhere in this application and can thus comprise additives for fine-tuning the properties of the matrix as an addition to the base polymer. The polymer matrix m is preferably of a hard non-elastomer. The reinforcing fibers f being in the polymer matrix means here that in the invention the individual reinforcing fibers are bound to each other with a polymer matrix m e.g. in the manufacturing phase by embedding them together in the molten material of the polymer matrix. In this case the gaps of individual reinforcing fibers bound to each other with the polymer matrix comprise the polymer of the matrix. In this way a great number of reinforcing fibers bound to each other in the longitudinal direction of the rope are distributed in the polymer matrix. The reinforcing fibers are preferably distributed essentially evenly in the polymer matrix such that the load bearing member is as homogeneous as possible when viewed in the direction of the cross-section of the rope. In other words, the fiber density in the cross-section of the load bearing member does not therefore vary greatly. The reinforcing fibers f together with the matrix m form a uniform load bearing member, inside which abrasive relative movement does not occur when the rope is bent. The individual reinforcing fibers of the load bearing member 7,7' are mainly surrounded with polymer matrix m, but fiber-fiber contacts can occur in places because controlling the position of the fibers in relation to each other in their simultaneous impregnation with polymer is difficult, and on the other hand, perfect elimination of random fiber-fiber contacts is not necessary from the viewpoint of the functioning of the invention. If, however, it is desired to reduce their random occurrence, the individual reinforcing fibers f can be pre-coated such that a polymer coating is around them already before the binding of individual reinforcing fibers to each other. In the invention the individual reinforcing fibers of the load bearing member can comprise material of the polymer matrix around them such that the polymer matrix is immediately against the reinforcing fiber but alternatively a thin coating, e.g. a primer arranged on the surface of the reinforcing fiber in the manufacturing phase to improve chemical adhesion to the matrix material, can be in between. Individual reinforcing fibers are distributed evenly in the load bearing member 7,7' such that the gaps of individual reinforcing fibers f are filled with the polymer of the matrix m. Most preferably the majority, preferably essentially all of the gaps of the individual reinforcing fibers f in the load bearing member are filled with the polymer of the matrix. The matrix m of the load bearing member 15 is most preferably hard in its material properties. A hard matrix m helps to support the reinforcing fibers f, especially when the rope bends, preventing buckling of the reinforcing fibers f of the bent rope, because the hard material supports the fibers f. To reduce the buckling and to facilitate a small bending radius of the rope, among other things, it is therefore preferred that the polymer matrix is hard, and therefore preferably something other than an elastomer (an example of an elastomer: rubber) or something else that behaves very elastically or gives way. The most preferred materials are epoxy resin, polyester, phenolic plastic or vinyl ester. The polymer matrix is preferably so hard that its module of elasticity (E) is over 2 GPa, most preferably over 2.5 GPa. In this case the module of elasticity (E) is preferably in the range 2.5-10 GPa, most preferably in the range 2.5-3.5 GPa. Preferably over 50% of the surface area of the cross-section of the load bearing member is of the aforementioned reinforcing fiber, preferably such that 50%-80% is of the aforementioned reinforcing fiber, more preferably such that 55%-70% is of the aforementioned reinforcing fiber, and essentially all the remaining surface area is of polymer matrix. Most preferably such that approx. 60% of the surface area is of reinforcing fiber and approx. 40% is of matrix material (preferably epoxy). In this way a good longitudinal strength of the rope is achieved.

In the embodiments illustrated in FIGS. 2*a*,2*b*,3,4,5*a* to 5*c* the elevator comprises one or more rope wheel 3', 5*a*, 5*b*, 5*a*', 5*b*', 6, 6', 11' having its plane of rotation parallel with the vertical side wall plane of the car 1 and/or the vertical hoistway inner wall plane W around which rope wheel 3', 5*a*, 5*b*, 5*a*', 5*b*', 6, 6', 11' the rope 2,2' turns its wide side against the circumference of the wheel in question such that the rope 2,2' turns around an axis extending in width-direction of the rope 2,2'. Said rope wheel 3', 5*a*, 5*b*, 5*a*', 5*b*', 6, 6', 11' is mounted on the car 1 at the side thereof or separate from the car 1 and positioned beside the vertical projection of the car 1, whereby the width of the rope bundle and the axial size of the wheel in question are important factors defining the minimal distance between car wall and the hoistway inner wall plane W. Minimizing the width of the rope bundle reduces need for rope wheels large in axial direction, as well as reduces space consumption of the rope bundle. The rope(s) 2,2' furthermore arrive(s) to and/or depart(s) from the rope wheel 3', 5*a*, 5*b*, 5*a*', 5*b*', 6, 6', 11' in question such that it/they pass(es) beside the car 1, which further increases the meaning of the described effect of the width of the rope bundle.

For the tightening device also different structures could be utilized than what is disclosed in the examples, where tension of the first rope section for tightening the second rope section is utilized. Such alternative solutions may include for instance a weight tightener, or a spring tightener. In case of a spring tightener, a spring is arranged to direct a tightening force to the second rope section, either acting via a rope wheel on the side of the second rope section or being the medium via which an end of the second rope section is fixed to a stationary structure or to the car, depending on which hoisting ratio is preferred for the elevator. In those cases, the first rope section need not be connected to the tightening device but may be fixed for example to a stationary structure or to the car, depending on which hoisting ratio is preferred for the elevator.

In this application, the term load bearing member refers to the part of the rope that is elongated in the longitudinal direction of the rope 2,2', extending all the length thereof, and which part is able to bear without breaking a significant part of the load exerted on the rope in question in the longitudinal direction of the rope. Such load causes tension on the load bearing member in the longitudinal direction of the rope, which tension can be transmitted inside the load bearing member in question all the way from one end of the rope to the other end of the rope.

As described the ropes are preferably contoured, but this is not necessary. In particular, it is possible to alternatively form said rope(s) without grooves and ribs.

It is to be understood that the above description and the accompanying Figures are only intended to illustrate the present invention. It will be apparent to a person skilled in the art that the inventive concept can be implemented in various ways. The invention and its embodiments are not limited to the examples described above but may vary within the scope of the claims.

The invention claimed is:

1. A counterweightless elevator comprising:

a hoistway;

a car vertically movable in the hoistway;

one or more suspension ropes;

a rotatable drive member, provided on a first side of the car and engaging said suspension rope(s), each of the suspension rope(s) having a first rope section on a first side of the drive member and a second rope section on a second side of the drive member, each rope section being connected to the car, wherein said first rope section passes from the rotatable drive member down to a first rope wheel mounted on a bottom of the car, and is then guided upwards to pass over an upper rope wheel provided on a second side of the car, forming a first rope loop suspending the car, said second rope section passes from the rotatable drive member to a second rope wheel mounted at a lower end of the hoistway, forming a second rope loop which is suspended by the car via a third rope wheel mounted on the bottom of the car, and each of the first rope wheel and the second rope wheel has an axis of rotation which is orthogonal to an axis of rotation of the rotatable drive member; and a tightening device arranged to tighten the second rope section, wherein the second rope section is guided from the second rope wheel to the tightening device, and from the tightening device to the upper rope wheel provided on the second side of the car;

wherein each of said rope(s) is belt-like and comprises a load bearing member or a plurality of load bearing members, which load bearing member(s) is/are made of composite material comprising reinforcing fibers embedded in a polymer matrix, which reinforcing fibers are carbon fibers.

2. The elevator according to claim 1, wherein said load bearing member(s) is/are parallel with the longitudinal direction of the rope.

3. The elevator according to claim 2, wherein said the reinforcing fibers are parallel with the longitudinal direction of the load bearing member.

4. The elevator according to claim 2, wherein said the second rope section is connected to a movably mounted tightening member of the tightening device of the second rope section, which tightening member is movable to tighten the second rope section.

5. The elevator according to claim 1, wherein said reinforcing fibers are parallel with the longitudinal direction of the load bearing member.

6. The elevator according to claim 5, wherein said the second rope section is connected to a movably mounted tightening member of the tightening device of the second rope section, which tightening member is movable to tighten the second rope section.

7. The elevator according to claim 1, wherein said second rope section is connected to a movably mounted tightening member of the tightening device of the second rope section, which tightening member is movable to tighten the second rope section.

8. The elevator according to claim 1, wherein the tightening device is mounted on the car at the side thereof, or on the stationary hoistway structures beside the vertical projection of the car, beside the path of the elevator car.

9. The elevator according to claim 1, wherein the tightening device is mounted on the car at the side thereof, or on the stationary hoistway structures beside the vertical projection of the car, and the tightening member is movable along a vertical plane, which is parallel with the side wall plane of the car and/or hoistway inner wall plane to tighten the second rope section.

10. The elevator according to claim 1, wherein the tightening member is between the vertical side wall plane of the car and a vertical hoistway inner wall plane.

11. The elevator according to claim 1, wherein said first rope section, suspending the car is tensioned by the weight of the car, and guided to pass further to said tightening device of the second rope section and connected in a force transmitting manner to said movably mounted tightening member to pull the tightening member by effect of the rope tension of the first rope section such that the tightening member moves to tighten the second rope section.

12. The elevator according to claim 1, wherein the tightening member is in the form of a tightening pulley around which the second rope section passes, the tightening member being movable in radial direction of the tightening pulley and/or around its axis, to tighten the second rope section.

13. The elevator according to claim 12, wherein the plane of rotation of the tightening pulley is parallel with the side wall plane of the car and/or hoistway inner wall plane.

14. The elevator according to claim 1, wherein the tightening member is in the form of a tightening pulley around which the second rope section passes, the tightening member being movable in radial direction of the tightening pulley to tighten the second rope section, the end of the first rope section being connected in a force transmitting manner to the movably mounted tightening pulley to pull the tightening pulley by effect of the rope tension of the first rope section such that the tightening pulley moves radially to tighten the second rope section.

15. The elevator according to claim 1, wherein the tightening member is in the form of a tightening pulley around which the second rope section passes and against the rim of which the second rope section is fixed, the tightening member being movable around its axis to tighten the second rope section, the end of the first rope section being connected in a force transmitting manner to the movably mounted tightening pulley to pull the tightening pulley by effect of the rope tension of the first rope section such that the tightening pulley turns to tighten the second rope section.

16. The elevator according to claim 1, wherein each of said rope(s) has at least one contoured side provided with elongated guide rib(s) and elongated guide groove(s) oriented in the longitudinal direction of the rope, said contoured side being fitted to pass against a contoured circumference of one or more rope wheels of the elevator, said circumference being provided with elongated guide rib(s) and elongated guide groove(s) so that said contoured circumference forms a counterpart for said contoured side(s) of the rope(s).

17. The elevator according to claim 1, wherein each of said rope(s) has at least one contoured side provided with elongated guide rib(s) and elongated guide groove(s) oriented in the longitudinal direction of the rope, the contoured side of at least the first or the second rope section being fitted to pass against a contoured circumference of a rope wheel of the elevator, which circumference is provided with elongated guide rib(s) and elongated guide groove(s) so that said contoured circumference forms a counterpart for said contoured side(s) of the rope(s), and from said rope wheel, the first or the second rope section passes downwards or upwards to the tightening device to a pulley thereof, turning around a longitudinal axis thereof.

18. The elevator according to claim 1, wherein the first and/or second rope section passes to the tightening device turning around a longitudinal axis thereof in a space between a vertical projection of the car and a vertical hoistway inner wall plane.

19. The elevator according to claim 1, wherein the tightening device is mounted on the car at the side thereof, or on the stationary hoistway structures beside the vertical projection of the car.

20. The elevator according to claim 1, wherein each of said rope(s) has at least one contoured side provided with elongated guide rib(s) and elongated guide groove(s) oriented in the longitudinal direction of the rope, the contoured side of at least the first or the second rope section being fitted to pass against a contoured circumference of a rope wheel of the elevator, which circumference is provided with elongated guide rib(s) and elongated guide groove(s) so that said contoured circumference forms a counterpart for said contoured side(s) of the rope(s), and from said rope wheel, the first or the second rope section passes downwards or upwards to the tightening device.

* * * * *